US005368382A

United States Patent [19]

Kawasaki et al.

[11] Patent Number: 5,368,382

[45] Date of Patent: Nov. 29, 1994

[54] CEMENT PASTE MIXER AND METHOD FOR PRODUCING MORTAR AND CONCRETE

[75] Inventors: Kenji Kawasaki, Suita; Masashi Kawakami, Nishinomiya; Kenji Suzukawa, Neyagawa; Setsu Wada, Higashiosaka, all of Japan

[73] Assignee: Konoike Construction Co., Ltd., Osaka, Japan

[21] Appl. No.: 46,870

[22] Filed: Apr. 16, 1993

Related U.S. Application Data

[62] Division of Ser. No. 923,585, Aug. 3, 1992.

[30] Foreign Application Priority Data

Aug. 2, 1991 [JP] Japan ..... 3-194305

[51] Int. Cl.[5] ..... B01F 5/00

[52] U.S. Cl. ..... 366/2; 366/6; 366/337

[58] Field of Search ..... 366/1, 2, 3, 6, 10, 366/14, 15, 51, 64, 65, 66, 154, 336, 337, 338, 339

[56] References Cited

U.S. PATENT DOCUMENTS

| | | | |
|---|---|---|---|
| 4,039,170 | 8/1977 | Cornwell et al. | 366/29 |
| 4,403,863 | 9/1983 | Fukushima et al. | 366/8 |
| 4,552,463 | 11/1985 | Hodson | 366/295 |
| 4,560,284 | 12/1985 | Chen | 366/336 |
| 4,619,531 | 10/1986 | Dunstan | 366/3 |
| 4,632,568 | 12/1986 | Emele et al. | 366/336 |
| 4,801,210 | 1/1989 | Gian | 366/3 |
| 4,830,505 | 5/1989 | Dunton et al. | 366/14 |
| 4,848,920 | 7/1989 | Heathe et al. | 366/339 |

*Primary Examiner*—David A. Scherbel
*Assistant Examiner*—Reginald L. Alexander
*Attorney, Agent, or Firm*—Wenderoth, Lind & Ponack

[57] ABSTRACT

There is provided in a pressure feed pipe for feeding cement paste under pressure a wall panel assembly formed of a plurality of wall panels having collision surfaces and through holes and arranged at predetermined intervals. High-strength or superhigh-strength mortar or concrete is produced by kneading a designed amount of binder material comprising cement or cement and a pozzolan material together with a predetermined amount of water, passing this cement paste through the abovementioned pressure feed pipe to crush the cement balls contained in the cement paste and thus to homogenize the paste, and kneading the thus homogenized cement paste together with fine aggregate or fine and coarse aggregates.

4 Claims, 14 Drawing Sheets

CEMENT PASTE MIXER AND METHOD FOR PRODUCING MORTAR AND CONCRETE

This is a divisional application of Ser. No. 07/923,585, filed Aug. 3, 1992.

BACKGROUND OF THE INVENTION

The present invention relates to a mixer for crushing cement balls contained in cement paste to homoginize the cement paste and a method of producing high-strength or ultra-high strength concrete or mortar by use of the mixer.

Heretofore, as a technique for kneading concrete, as shown in FIG. 14, a so-called batch kneading method has been widely used in which water, cement, fine aggregate, coarse aggregate, pozzolan and admixtures are put in a mixer at a time and kneaded together. In order to produce high-strength, high-quality concrete, a double-mixing method as shown in FIG. 15 is also used these days. In this method, only cement paste or mortar is kneaded in a mixer and then fine aggregate and coarse aggregate are added to the cement paste and kneaded together to produce concrete. Mixers used for producing concrete in these methods include gravity type mixers, horizontal pan type forced action mixers, twin-shaft mixers, continuous kneading mixers, omni-mixers, etc.

But, cement to be treated with the batch kneading process has a fine particle size (approx. 5500 $cm^2/g$ in specific surface area). Thus, very hard cement balls are formed by a large cohesive force produced when the cement contacts water. It is difficult to crush such cement balls even if the cement is kneaded together with fine aggregate and coarse aggregate with a conventional mixer as described above. This hampers the production of concrete made of uniform cement paste. Concrete using a pozzolan material having a super-fine particle size (about 20 $m^2/g$ in specific surface area) such as silica fume shows a particularly strong cohesive force between the pozzolan material and water. Thus, the above-described mixers can hardly crush the cement balls made of this material.

There is a growing tendency these days to use super-high-strength materials (1000 kg $f/cm^2$ at the age of 28 days) as concrete for super-high-rise building structures. Since such concrete uses, in addition to a super-fine pozzolan material, a high-performance water reducing agent or a high superplasticizer in order to reduce the ratio of a water binding agent, its viscosity is extremely high. Thus, it is virtually impossible with the conventional batch mixing method shown in FIG. 14 to crush cement balls even if a powerful forced action mixer is used. Thus it is impossible to produce high-quality, high-strength or super-high strength concrete.

With the double mixing method shown in FIG. 15, since a conventional mixer as described above is used to knead cement paste or mortar, the crushing of the cement balls difficult. Thus, high-quality, high-strength concerete is difficult to obtain.

SUMMARY OF THE INVENTION

An object of the present invention is to provide a cement paste mixer for homogenizing cement paste by crushing cement balls contained in the cement paste and to provide a method for producing high-strength or super-high-strength mortar or concrete by use of the abovementioned cement paste mixer.

According to the present invention, in order to solve the above problems, in a pressure feed pipe for feeding cement paste under pressure there is provided a wall panel assembly comprising a plurality of wall panels having collision surfaces and through holes and arranged at predetermined intervals. Cement paste containing cement balls produced in a pre-kneading mixer is fed through the pressure feed pipe. The cement paste is then kneaded in a mixer for producing concrete or mortar together with fine aggregate or fine and coarse aggregate.

By feeding cement paste containing cement balls through the pressure feed pipe, the cement paste passes through the through holes in the wall panels of the wall panel assembly mounted in the pressure feed pipe while colliding with the collision surfaces on the wall panels. With a swirl being formed, a strong shearing force acts on the cement balls. The cement balls are thus crushed so that the cement paste is homogenized.

Thus, high-strength or superhigh-strength mortar or concrete is produced by kneading a designed amount of binder material comprising cement or cement and a pozzolan material together with a predetermined amount of water to produce cement paste, feeding the cement paste through the abovementioned pressure feed pipe to crush the cement balls contained in the cement paste and thus homogenize the paste, and kneading the thus homogenized cement paste together with fine aggregate or both fine and coarse aggregates.

Mortar or concrete produced according to the present invention has much higher quality and strength than those produced by conventional methods with the same composition and content of the material. Also, a predetermined strength can be attained with a smaller amount of cement and fine-grain or superfine-grain pozzolan material. This is economically advantageous. Further, concrete can be produced efficiently. Thus, high-quality concrete structures can be built economically.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1A:
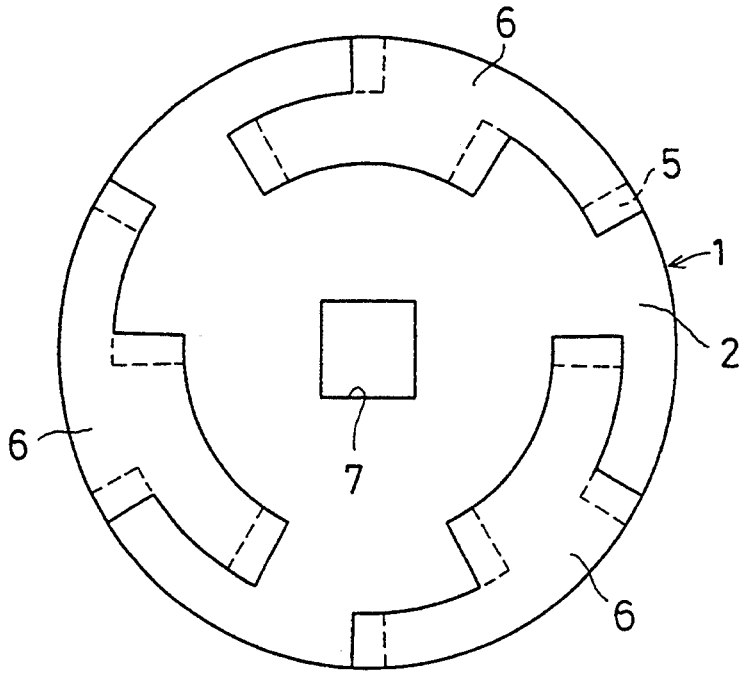
FIG. 1A is a plan view of an embodiment of the wall panel.
Figure 1B:
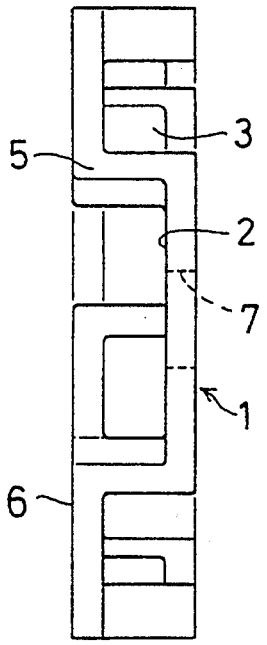
FIG. 1B is a side view of the same.
Figure 1C:
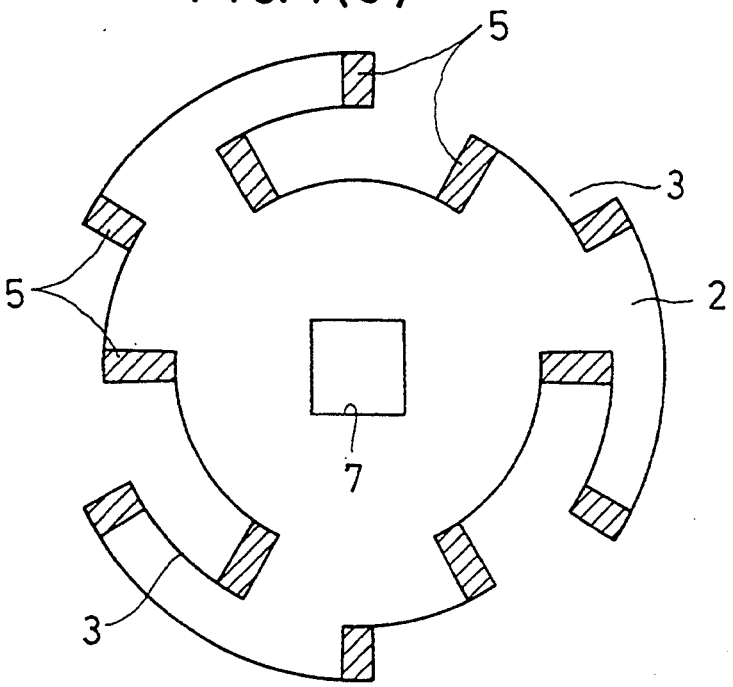
FIG. 1C is a cross-sectional view of the same.

A cement paste mixer according to the present invention is a wall panel assembly comprising a plurality of wall panels 1 having a collision surface 2 and through-holes 3 and arranged at predetermined intervals. This assembly is mounted in a pressure feed pipe 4 of a tubing pump for feeding cement paste under pressure.

FIGS. 1–4 show one embodiment of the wall panel 1. The wall panel 1 has three cutouts along the outermost peripheral edge and three additional cutouts in the outer part immediately inside the outermost peripheral edge. Each pair of inner and outer cutouts form the through hole 3. Each cutout has a length substantially equal to one-sixth of the circumference of the wall panel 1 and is spaced apart a distance substantially equal to one-sixth of the circumference from the adjacent cutouts. Each cutout 2 formed in the outer part of the panel 1 immediately inside the outermost peripheral edge is circumferentially offset from the corresponding cutout formed along the outermost peripheral edge so that they communicate with each other over half the entire length thereof. Pillar walls 5 having substantially the same height as the width of the cutouts are provided at both ends of the cutouts formed in the outermost peripheral edge and in the outer part immediately inside the outer peripheral edge. A roof wall 5 having the same contour as each through hole 3 defined by each pair of inner and outer cutouts is supported on the pillar walls 5. The collision surface 2 of the wall panel 1 is defined by the roof walls 6 and a disk-shaped surface.

Figure 2:
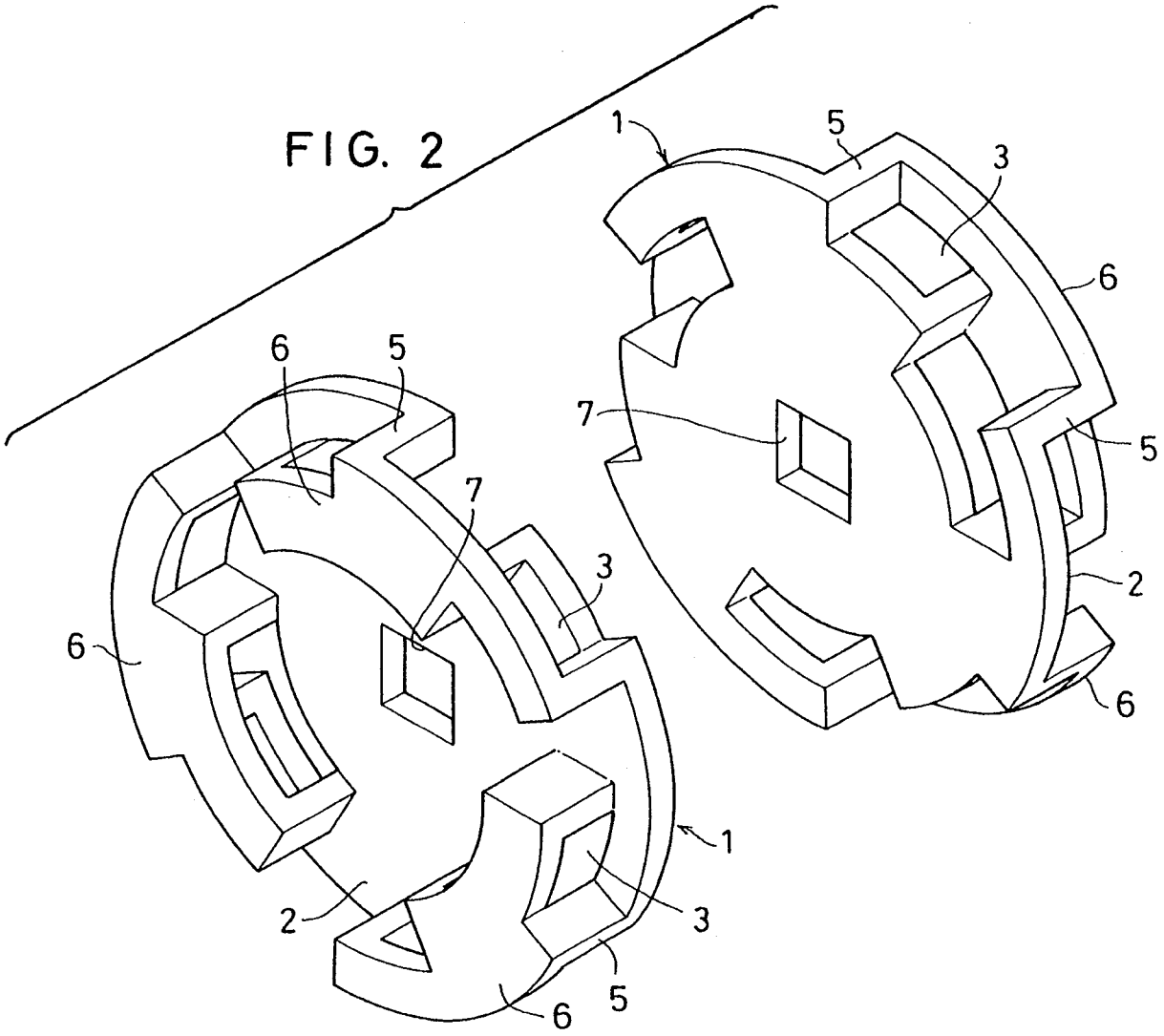
FIG. 2 is a perspective view of two wall panels shown in FIG. 1, positioned in opposite ways to each other so as to face each other.
Figure 3:
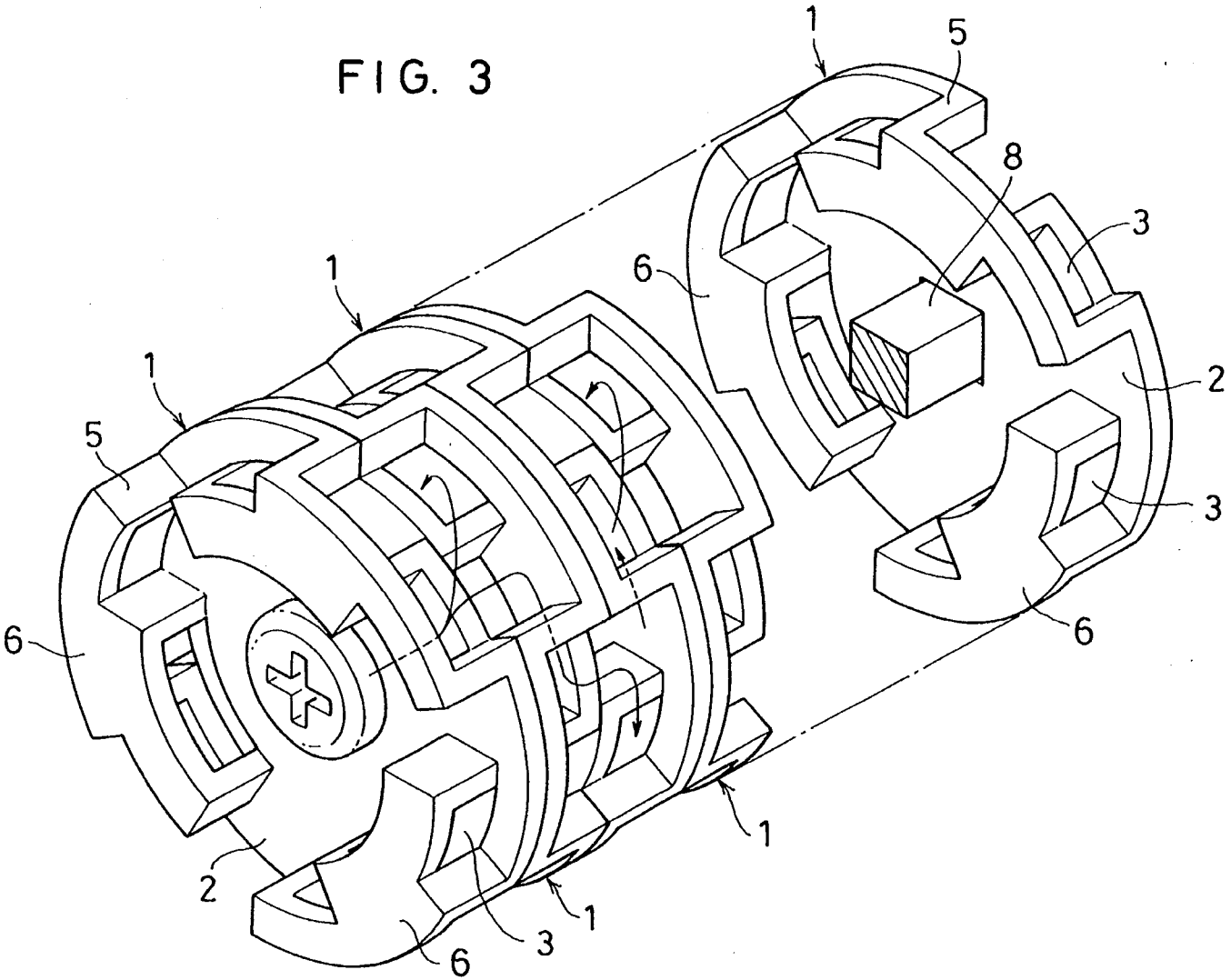
FIG. 3 is a perspective view of the wall panel assembly.

The wall panel has a square hole 7 in the center thereof. In combining a plurality of such wall panels 1 into a wall panel assembly, the wall panels are put one on another in alternately front-to-front and back-to-back relations as shown in FIGS. 2 and 3. Then a square bolt 8 is inserted into the square holes 7 in the wall panels 1 and a nut 9 is tightened onto the bolt to secure the panels 1 together.

Figure 4:
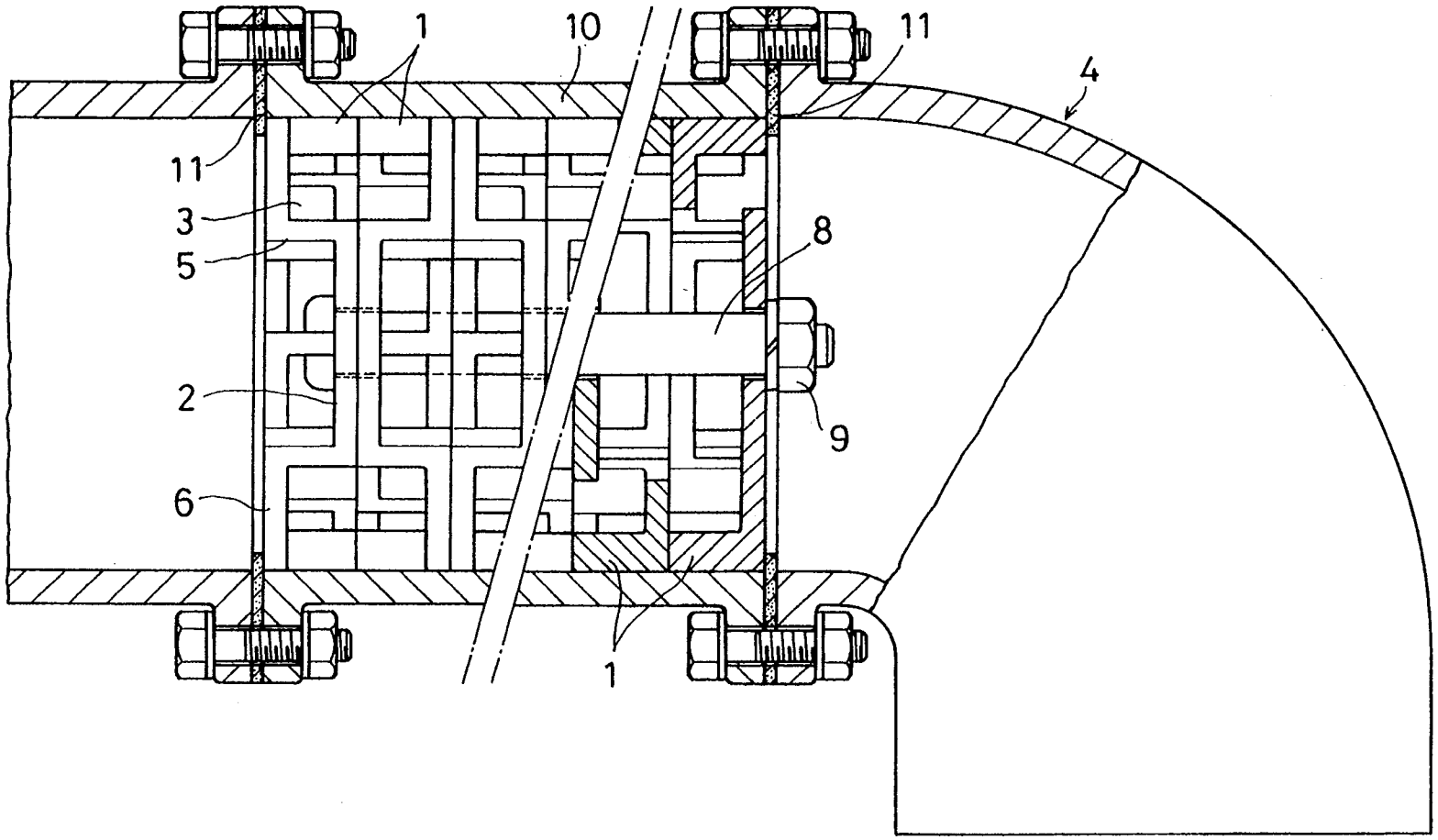
FIG. 4 is a sectional view of the wall panel assembly as mounted in a pressure feed pipe.

In order to install the wall panel assembly thus formed in the pressure feed pipe 4 of a tubing pump, as shown in FIG. 4, it is inserted in a steel-pipe joint portion 10 of a pressure feed pipe 4 so as to be supported unmovably by means of sealings 11 provided at both ends of the steel-pipe joint 10.

Figure 5A:
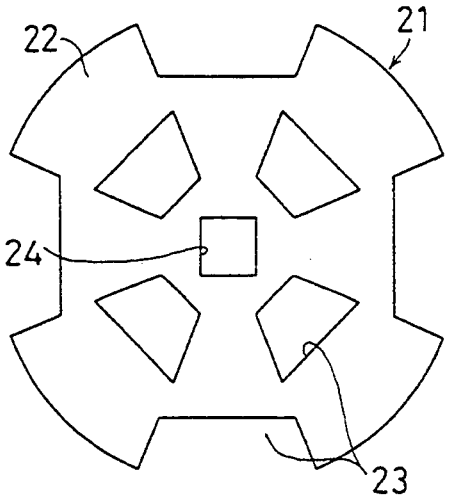
FIGS. 5A and 5B are plan views of another embodiment of the wall panel.
Figure 5B:
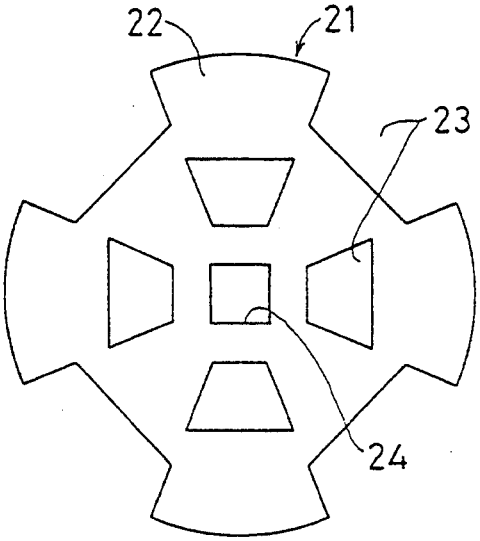
Figure 6:
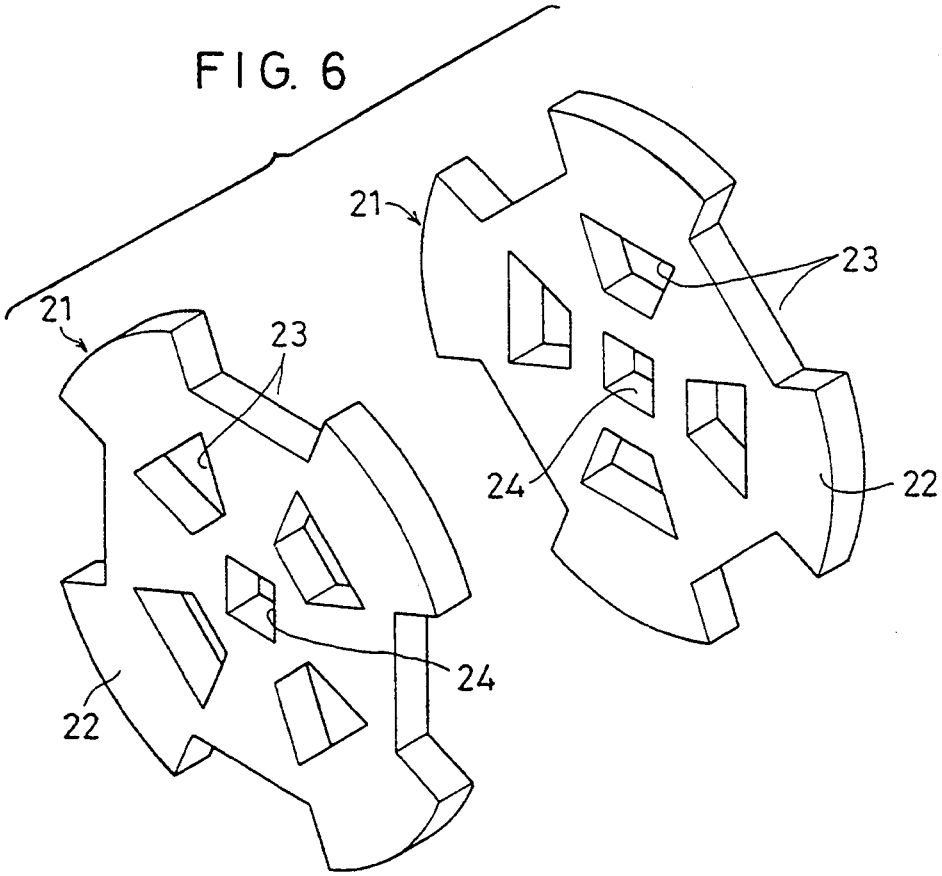
FIG. 6 is a perspective view of two wall panels, shown in FIGS. 5(A) and 5(B), arranged opposite to each other.
Figure 7:
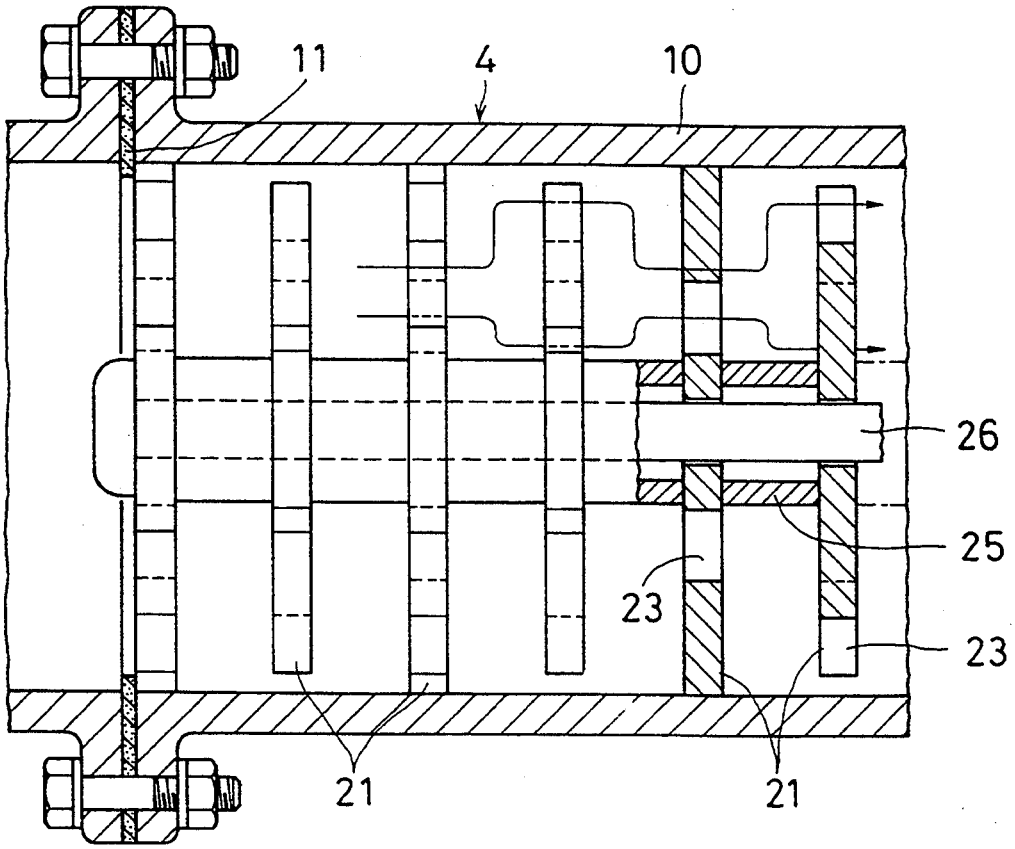
FIG. 7 is a sectional view of the wall panel assembly of FIGS. 5(A) and 5(B) as mounted in a pressure feed pipe.

FIGS. 5–7 show another example of the wall panel, designated by numeral 21. The wall panel 21 has four cutouts adjacent the outer peripheral edge thereof at equal angular intervals of 90 degrees. Inside the cutouts and independently thereof, a square hole is formed. The four cutouts and the square hole form through holes 23 and the remaining disk-shaped portion forms a collision surface 22.

In forming a wall panel assembly by combining a plurality of such wall panels 21, as shown in FIGS. 5A, 5B, two different kinds of wall panels 21 are prepared, i.e. those having their respective square holes 24 positioned differently with respect to the cutouts. They are arraged alternately with each other as shown in FIGS. 6 and 7 with spacers 25 sandwiched therebetween. Then a square bolt 26 is inserted into the square holes 24 and a nut is tightened on the bolt 26 to fix them together.

Now, the method of producing mortar or concrete using the cement paste mixer shown in FIGS. 1–4 will be described.

By kneading a designed amount of binding material such as cement or a mixture of cement and a pozzolan material together with a predetermined amount of kneading water in a cement paste mixer, cement paste containing a large amount of hard cement balls is obtained. Such cement paste is fed under pressure into a pressure feed pipe, having the mixer as shown in FIG. 4 therein, by means of a tubing pump. The cement paste is forced through the mixer in the pipe, following the path as indicated in FIG. 3. The cement balls are crushed by a strong shearing force due to a vortex that forms while the paste is being fed through the mixer, producing a very homogeneous cement paste.

Figure 9:
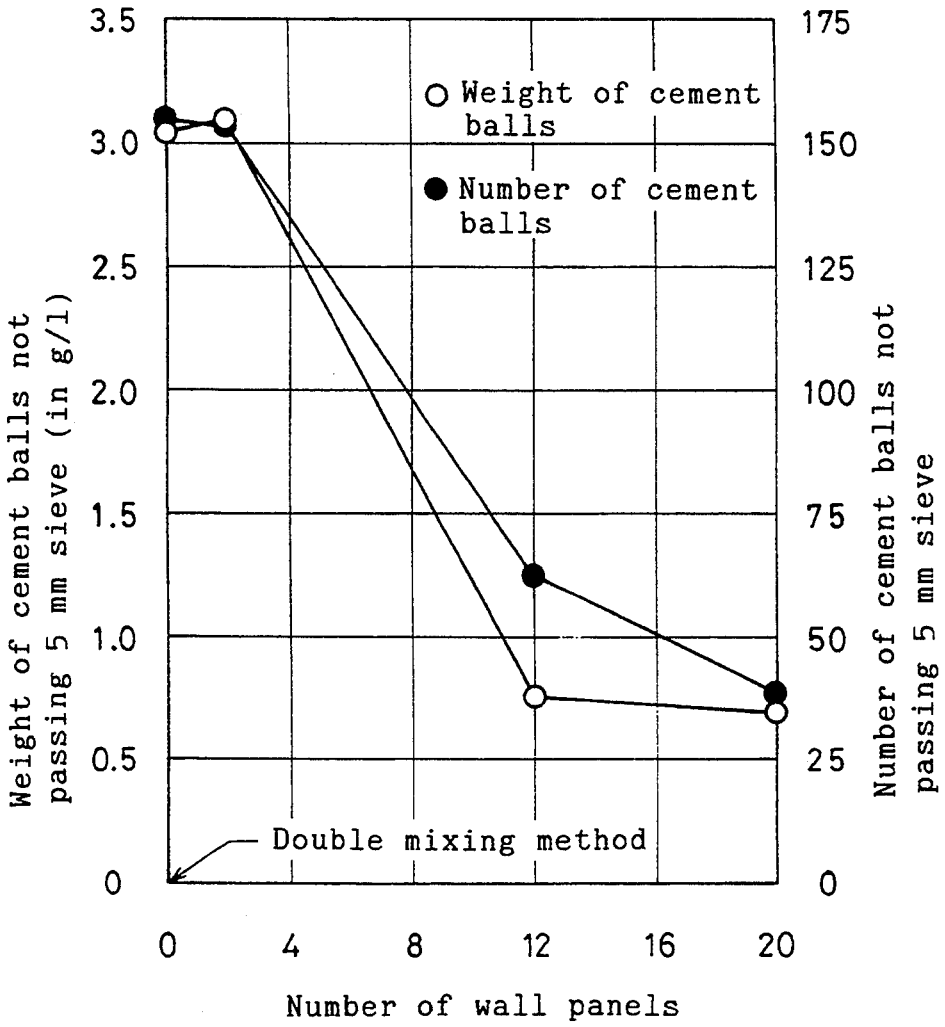
FIG. 9 is a graph showing the relation between the number of wall panels and the amount of cement balls.

FIG. 9 shows the relation between the number of cement balls having a particle diameter of 5 mm or greater and the number of the wall panels used and the relation between the weight of the cement balls having a particle diameter of 5 mm of greater and the number of the wall panels used. It is apparent from these curves that the cement balls reduce sharply both in number and weight by increasing the number of wall panels to 12 or mope. The cement balls having a particle diameter of 5 mm or more, too, are eventually crushed in the mixer in the pipe. In contrast, if cement paste containing cement balls is kneaded in a conventional mixer together with fine and coarse aggregates, the cement balls are too tough to be crushed easily. The concrete thus obtained will have low strength or its strength distribution will be uneven when compared with the concrete obtained by use of the mixer mounted in the pipe.

The cement paste, homogenized as a result of the crushing of the cement balls, is further kneaded in a conventional mixer together with a predetermined amount of fine and coarse aggregates to obtain high-quality, high-strength or superhigh-strength mortar, or high-strength, or superhigh-strength concrete.

Figure 10:
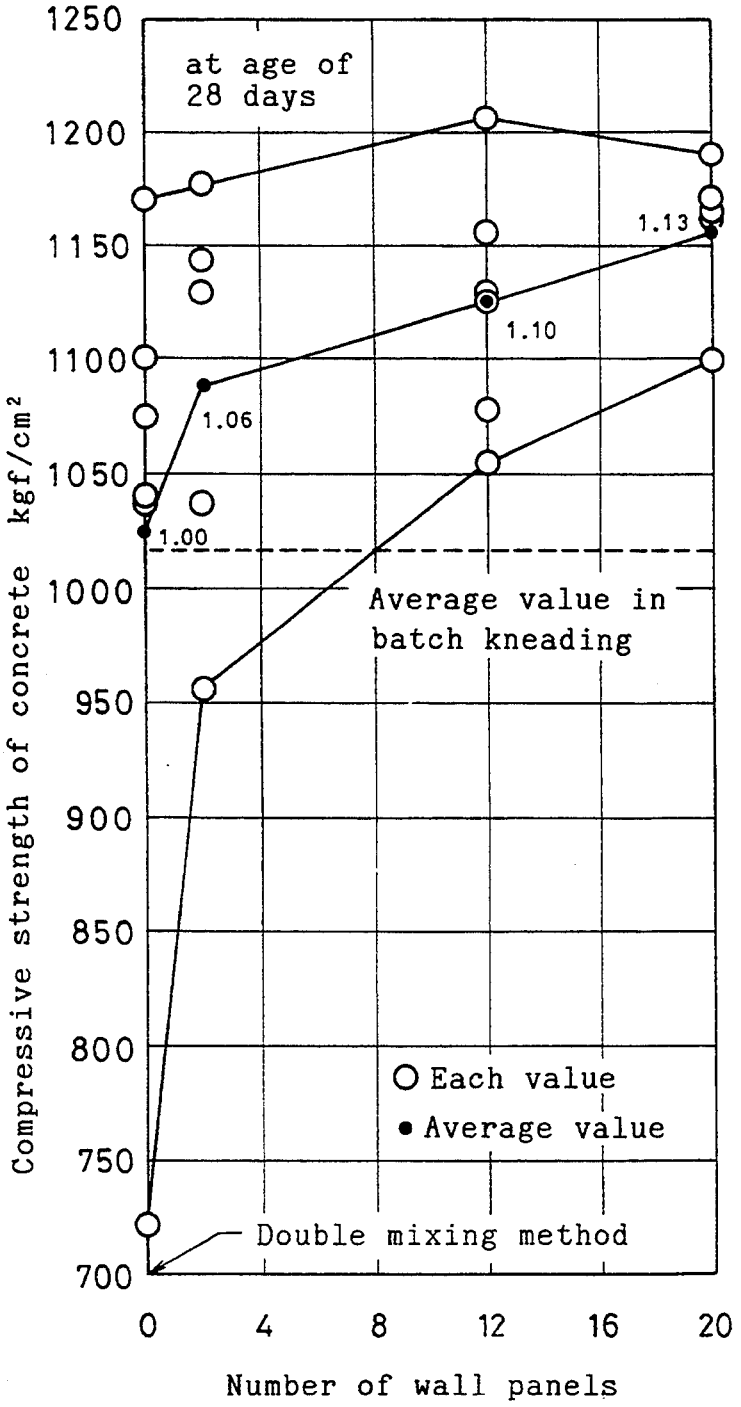
FIG. 10 is a graph showing the relation between the number of wall panels and the compressive strength of the concrete.
Figure 14:
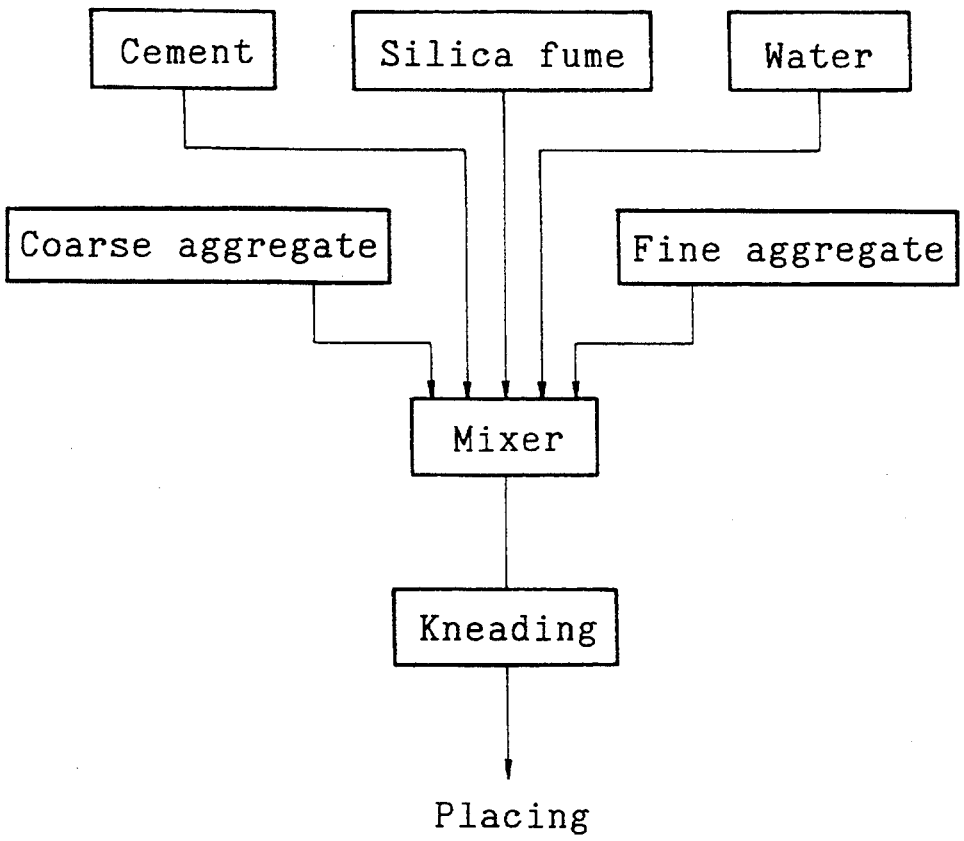
FIG. 14 is a flow chart showing the concrete production in the conventional batch kneading method.

FIG. 10 shows the relation between the compressive strength and the number of the wall panels used, evaluated as to specimens at the age of 28 days which are superhigh-strength silica fume concrete specimens having a composition as shown in Table 1 and produced according to the present invention. The cement paste was first kneaded in a twin-shaft mixer for two minutes and then kneaded in a horizontal pan type mixer for one minute. Namely, the cement paste was kneaded for three minutes in total to produce concrete. In other words, the concrete was kneaded for three minutes. The broken line in the figure represents an average strength of the concrete obtained by kneading three minutes according to the conventional batch kneading method shown in FIG. 14.

Figure 15:
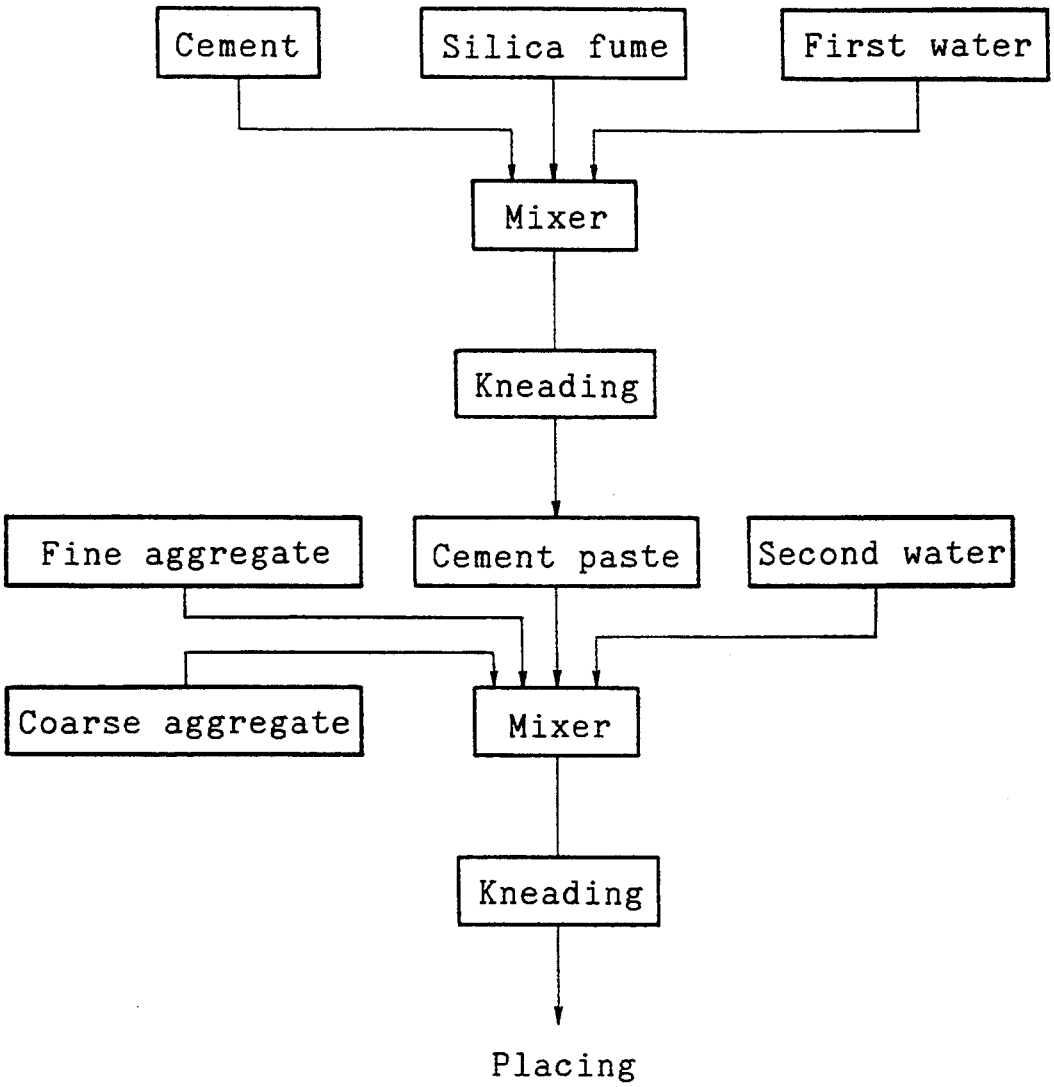
FIG. 15 is a flow chart showing the concrete production in the conventional double mixing method.

In the figure, the compressive strength when the number of wall plates is zero represents the compressive strength of the concrete produced by the conventional double mixing method shown in FIG. 15. FIG. 10 clearly shows that the compresslye strength of the concrete produced by the method according to the present invention is always greater than that of the concrete produced by the batch kneading method. Supposing the strength when no (zero) wall panel is used, that is to say, the strength of the concrete produced by the conventional double mixing method is 1.00, the use of two, 12 and 20 wall panels can increase the strength by factors of 1.06, 1.10 and 1.13, respectively. Namely, the concrete produced by the method acccording to the present invention exhibits greater strength than the concrete produced by the conventional double mixing method.

FIG. 10 also indicates the limit lines for the minimum strength and maximum strength for the respective numbers of wall panels. This figure shows that the smaller the number of wall panels, the greater the distance between the limit lines. To put it oppositely, the greater the number of wall panels, the smaller the distance between the limit lines. This in turn shows that the greater the number of wall panels, the smaller the variations in strength among the individual specimens.

Figure 11:
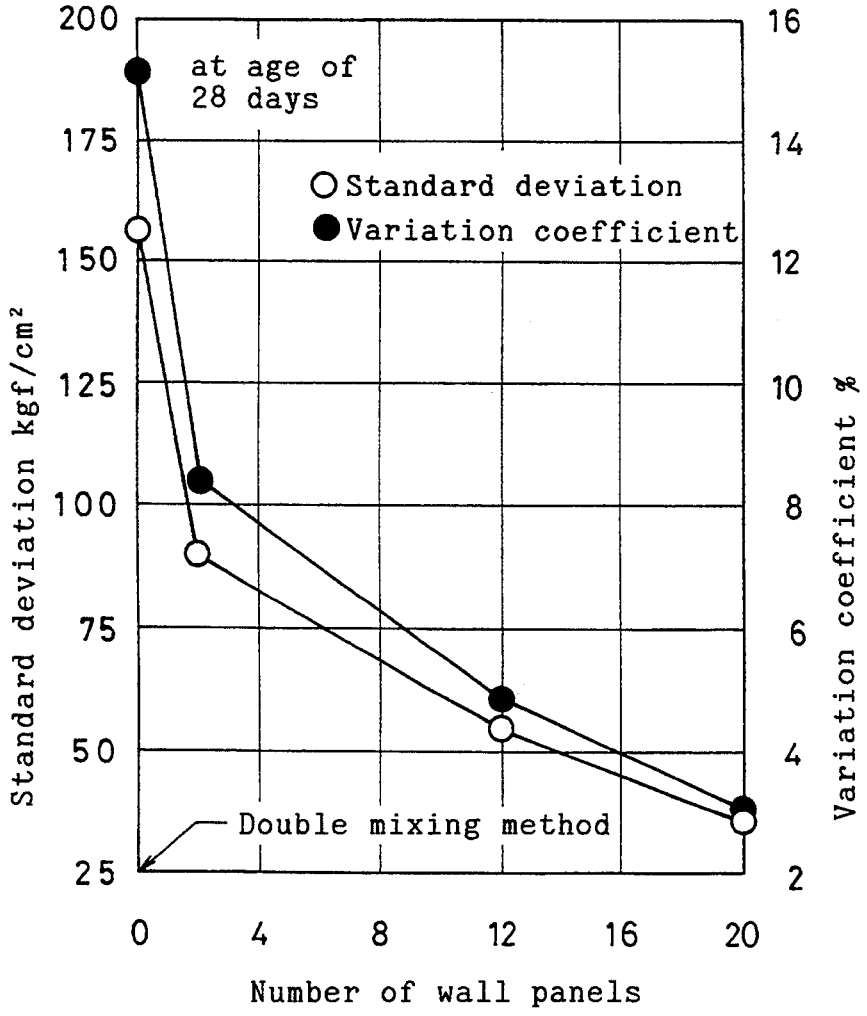
FIG. 11 is a graph showing the relation between the number of panels and the standard deviation of the concrete produced according to the present invention and the relation between the number of panels and the variation coefficient of the concrete produced according to the present invention.

FIG. 11 shows the relation between the standard deviation of the compresslye strength of the concrete produced by the method according to the present invention and the number of the wall panels used or the relation between the variation coefficient of the compressive strength of the concrete produced by the method according to the present invention and the number of the wall panels used. From this figure, it is apparent that the greater the number of the wall panels used, the smaller the standard deviation and the variation coefficient. It is thus proved, from a statistical viewpoint, that the concrete produced according to the present invention shows small variations in strength and that by using a sufficiently large number of wall panels, very high-quality concrete can be produced.

Figure 12:
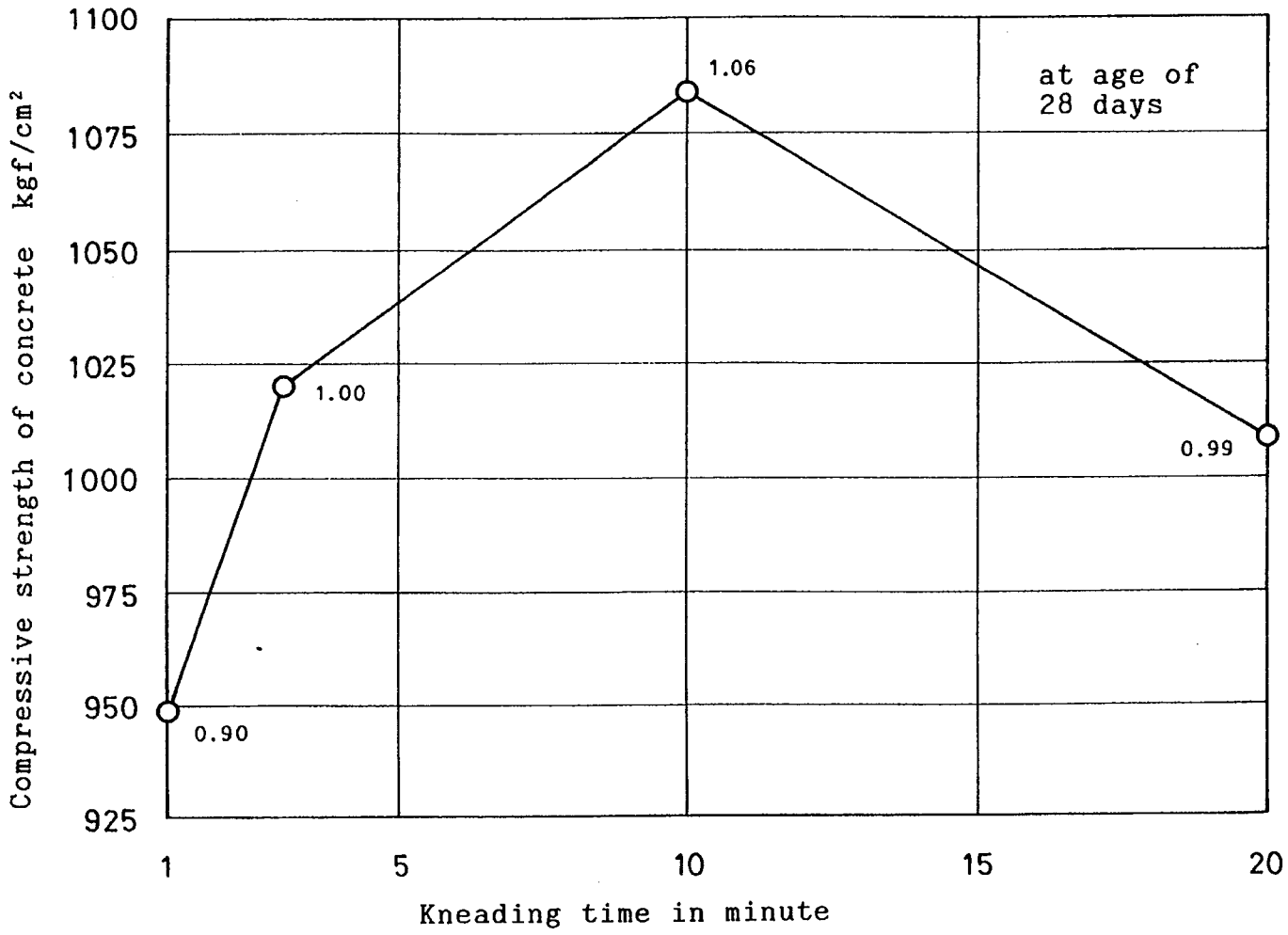
FIG. 12 is a graph showing the relation between the compressive strength of the concrete produced by a conventional batch kneading method and the kneading time.

FIG. 12 shows the relation between the compressive strength of concrete at the age of 28 days produced by the conventional batch kneading method and the kneading time in minutes. The concrete specimens produced by kneading one minute, 10 minutes and 20 minutes showed, respectively, compressive strengths 0.90, 1.06 and 0.99 times a standard value (1.00) which is the compressive strength of the concrete produced by kneading for three minutes. Namely, in the case of the conventional batch kneading method, there is an optimum kneading time, which is 10 minutes. The concrete produced by kneading for 10 minutes, which is the optimum time, has a strength 1.06 times the strength of the concrete produced by kneading for three minutes. When comparing this figure with the compressive strength of the concrete produced according to the present invention, it corresponds to the rate of increase in strength of the concrete when two wall panels are used. But this figure is smaller than the rate of increase in strength, i.e. 1.10 times, when 12 wall panels are used, and accounts for only about 50% or less of the increase rate in strength, i.e. 1.13 times, when 20 wall panels are used. Considering the fact that the method for producing concrete according to the present invention requires a total kneading time of only three minutes, the conventional batch kneading method, which requires 10 minutes for optimum kneading and still cannot increase the strength so remarkably, is quite unsatisfactory in efficiency and quality.

Figure 8:
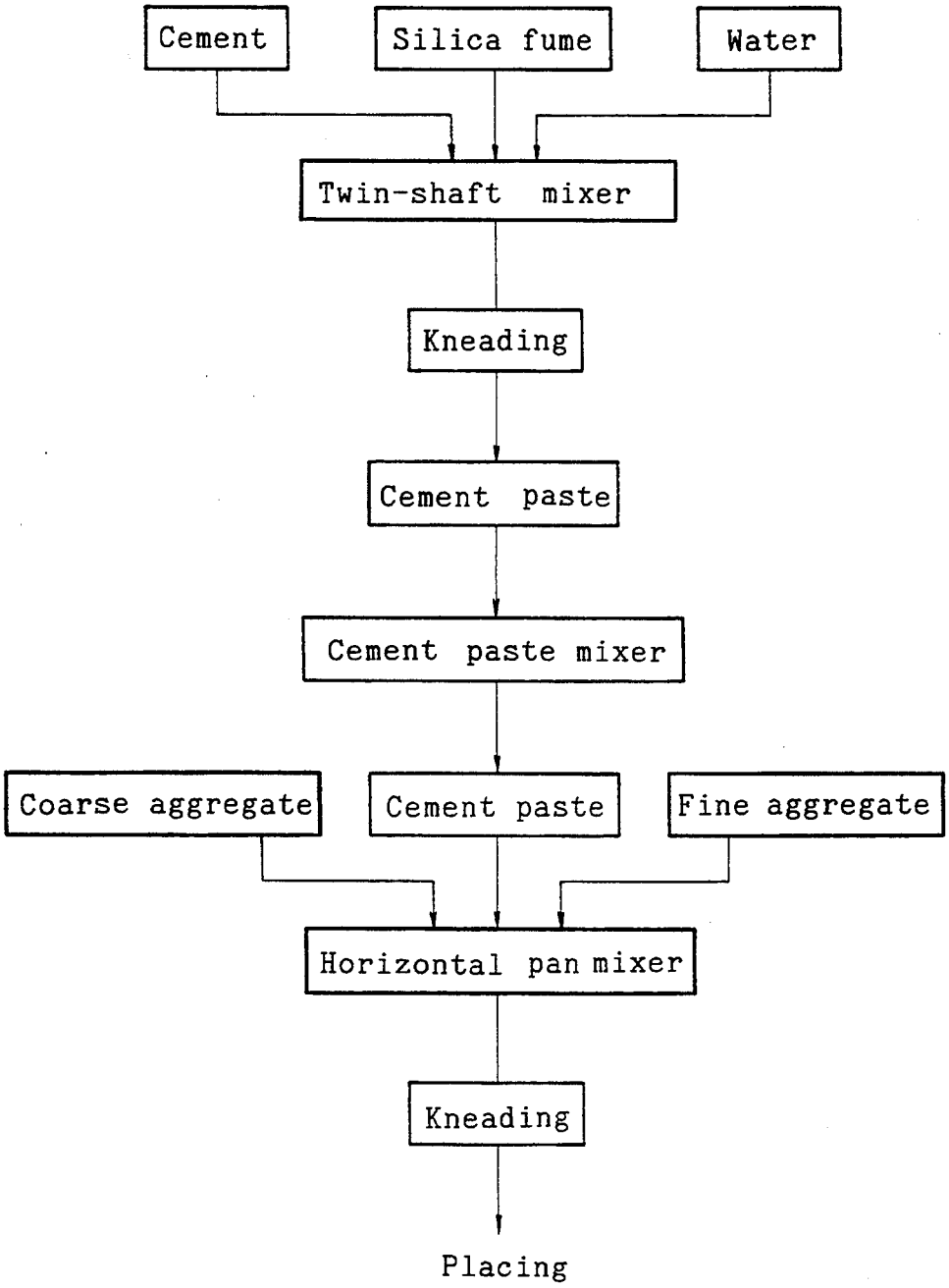
FIG. 8 is a flow chart showing the concrete production according to the present invention.
Figure 13:
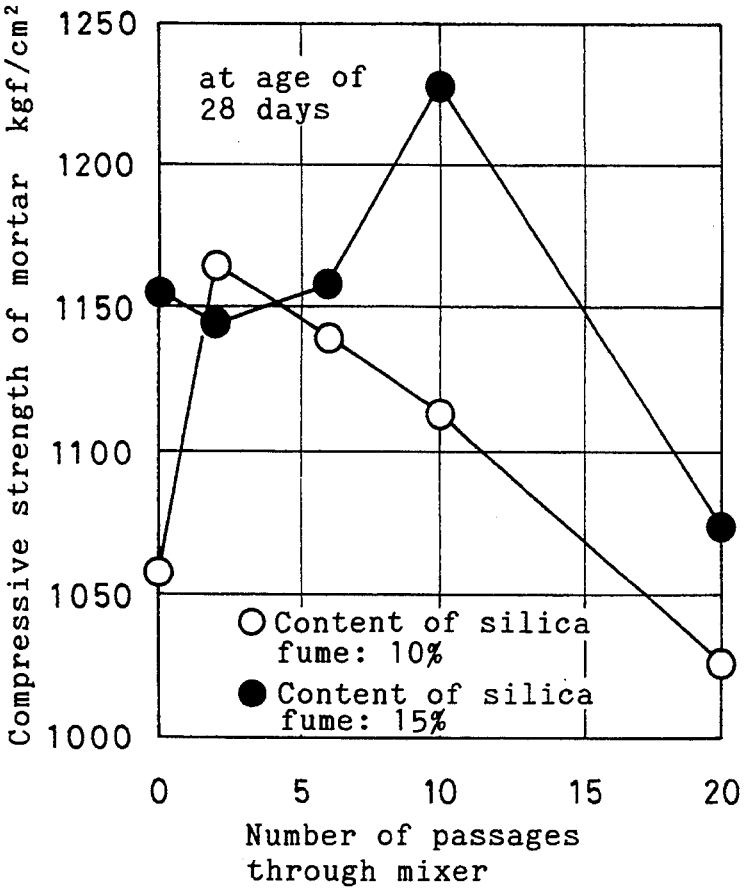
FIG. 13 is a graph showing the relation between the number of times the cement paste passes through the mixer according to the present invention and the compressive strength of the mortar thus made.

FIG. 13 shows, for two kinds of superhigh-strength mortar (the content of silica fume with respect to the weight of cement: 10%–15%) having a composition shown in Table 2, the relation between the strength of mortar produced by the method according to the present invention and the number of times the cement paste used for the production of mortar is fed through the mixer in the pipe. The same kneading method as shown in FIG. 8 was used. But, according to the present invention, a circulation type system is used so that cement paste can continuously pass many times through the mixer in the pipe having six wall panels. If the number of times the cement paste passes through the mixer in the pipe is zero, this means that the concrete is produced by the conventional batch kneading method.

From FIG. 13, it is apparent that there exists a number of times the cement paste passes through the mixer in the pipe at which the mortar strength reaches its maximum. For a silica fume content of 10%, mortar strength was 1164 kgf/cm$^2$ when the number of passages was two, which is 10% higher than the mortar strength of 1057 kgf/cm$^2$ when the number of passages is zero, i.e. when the concrete was produced by the batch kneading method. For a silica fume content of 15%, mortar strength was 1227 kgf/cm$^2$ when the number of passages was 10, which is 6% higher than the mortar strength of 1153 kgf/cm$^2$ when the number of passages is zero, i.e. when the concrete was produced by the batch kneading method. Thus, high-quality, high-strength mortar can be produced using the method according to the present invention.

What is claimed is:

1. A method of producing high-strength mortar, comprising the steps of kneading a designed amount of cement together with a predetermined amount of water to form cement paste; forcing said cement paste through a pressure feed pipe having mounted therein a mixer for cement paste to homogenize the cement paste, the mixer comprising a wall panel assembly having a plurality of discrete wall panels disposed in the axial direction of the portion of the pressure feed pipe in which the wall panel assembly is provided, said wall panels each having a collision surface extending perpendicular to the axial direction and through-holes, the through-holes of each of said wall panels being out of alignment with the through-holes of each said wall panel adjacent thereto in said assembly, and the at least one collision surface of each of said wall panels being aligned in said axial direction with the through-holes of each said wall panel adjacent thereto in said assembly, such that the cement paste forced through the through-holes of each of said wall panels collides with the at least one collision surface of the wall panel adjacent thereto in the assembly to break up any balls of cement in the cement paste; and kneading said cement paste together with a designed amount of fine aggregate.

2. A method of producing superhigh-strength mortar, comprising the steps of kneading a designed amount of binder material comprising cement and a pozzolan material together with a predetermined amount of water to form cement paste; forcing said cement paste through a pressure feed pipe having mounted therein a mixer for cement paste to homogenize the cement paste, the mixer comprising a wall panel assembly having a plurality of discrete wall panels disposed in the axial direction of the portion of the pressure feed pipe in which the wall panel assembly is provided, said wall panels each having a collision surface extending perpendicular to the axial direction and through-holes, the through-holes of each of said wall panels being out of alignment with the through-holes of each said wall panel adjacent thereto in said assembly, and the at least one collision surface of each of said wall panels being aligned in said axial direction with the through-holes of each said wall panel adjacent thereto in said assembly, such that the cement paste forced through the through-holes of each of said wall panels collides with the at least one collision surface of the wall panel adjacent thereto in the assembly to break up any balls of cement in the cement paste; and kneading said cement paste together with a designed amount of fine aggregate.

3. A method of producing high-strength concrete, comprising the steps of kneading a designed amount of cement together with a predetermined amount of water to form cement paste; forcing said cement paste through a pressure feed pipe having mounted therein a mixer for cement paste to homogenize the cement paste, the mixer comprising a wall panel assembly having a plurality of discrete wall panels disposed in the axial direction of the portion of the pressure feed pipe in which the wall panel assembly is provided, said wall panels each having a collision surface extending perpendicular to the axial direction and through-holes, the through-holes of each of said wall panels being out of alignment with the through-holes of each said wall panel adjacent thereto in said assembly, and the at least one collision surface of each of said wall panels being aligned in said axial direction with the through-holes of each said wall panel adjacent thereto in said assembly, such that the cement paste forced through the through-holes of each of said wall panels collides with the at least one collision surface of the wall panel adjacent thereto in the assembly to break up any balls of cement in the cement paste; and kneading said cement paste together with a designed amount of fine and coarse aggregate.

4. A method of producing superhigh-strength concrete, comprising the steps of kneading a designed amount of binder material comprising cement and a pozzolan material together with a predetermined amount of water to form cement paste; forcing said cement paste through a pressure feed pipe having mounted therein a mixer for cement paste to homogenize the cement paste, the mixer comprising a wall panel assembly having a plurality of discrete wall panels disposed in the axial direction of the portion of the pressure feed pipe in which the wall panel assembly is provided, said wall panels each having a collision surface extending perpendicular to the axial direction and through-holes, the through-holes of each of said wall panels being out of alignment with the through-holes of each said wall panel adjacent thereto in said assembly, and the at least one collision surface of each of said wall panels being aligned in said axial direction with the through-holes of each said wall panel adjacent thereto in said assembly, such that the cement paste forced through the through-holes of each of said wall panels collides with the at least one collision surface of the wall panel adjacent thereto in the assembly to break up any balls of cement in the cement paste; and kneading said cement paste together with a designed amount of fine and coarse aggregate.

* * * * *